United States Patent [19]

McLaughlin

[11] 4,165,542

[45] Aug. 28, 1979

[54] HEAD COVERING

[76] Inventor: Rita E. McLaughlin, P.O. Box 1662, Boston, Mass. 02105

[21] Appl. No.: 891,022

[22] Filed: Mar. 28, 1978

[51] Int. Cl.[2] ..... A42B 1/20

[52] U.S. Cl. ..... 2/209.1

[58] Field of Search ..... 2/209.1, 196, 175, 174, 2/195, 197, 198, 185 R, 199, 190, 206, 69; 150/1, 35; 190/42

[56] References Cited

U.S. PATENT DOCUMENTS

| | | | |
|---|---|---|---|
| 1,156,487 | 10/1915 | Kunstadter | 2/198 |
| 1,361,289 | 12/1920 | Rosenzweig | 2/19 G |
| 1,404,616 | 1/1922 | Kronthal | 2/197 |
| 3,285,307 | 11/1966 | Dormaier | 150/1 |
| 4,032,991 | 7/1977 | Vandeweghe | 2/206 X |
| 4,078,264 | 3/1978 | DeGennaro et al. | 150/1 X |

*Primary Examiner*—Peter Nerbun

*Attorney, Agent, or Firm*—Schiller & Pandiscio

[57] ABSTRACT

A head covering made of a flexible material and comprising a crown, brim and pocket. The pocket is attached inside-out to the interior of the crown and is dimensioned so that the crown and brim can be stored within the pocket by turning the pocket inside-in and stuffing the crown and brim into the pocket.

9 Claims, 3 Drawing Figures

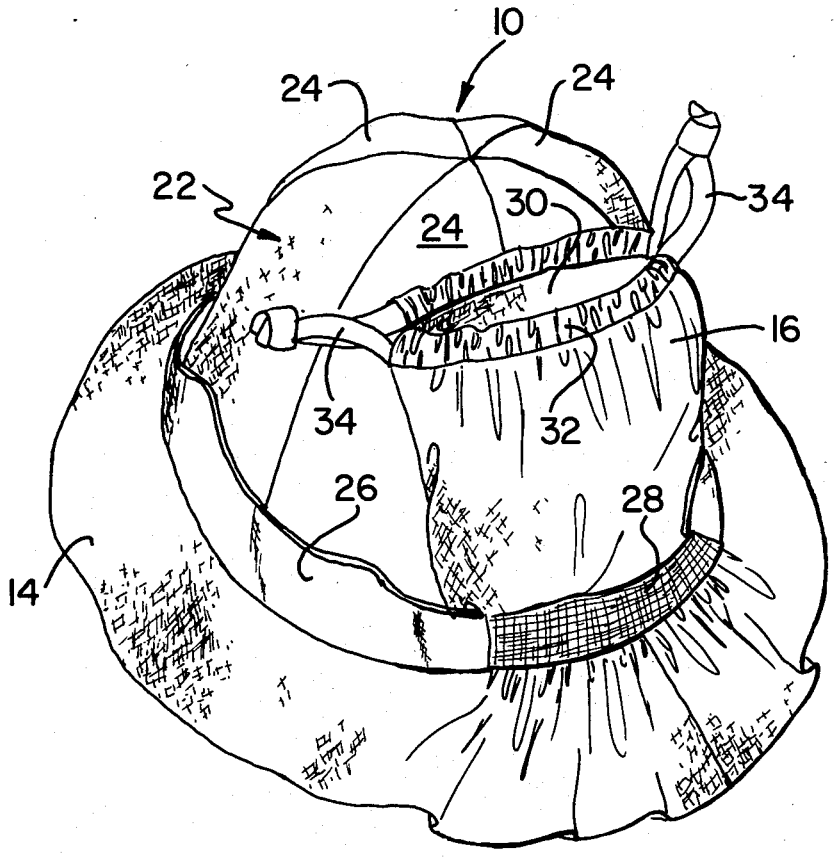

HEAD COVERING

The present invention generally relates to wearing apparel and more particularly to an improved head covering.

Head coverings come in a variety of shapes and sizes. Many, often rain hats, are of the type which can be folded and stored when not in use. Typically, however, these latter types are bulky and tend to unfold and thus can consume more space than desired, particularly where the space may be limited such as carrying purse. Further, the folded hat is not necessarily aesthetically pleasing, and when wet can provide unwanted water in the storage area.

Accordingly, objects of the present invention are to provide an improved head covering which can be easily stored in a minimum amount of space and in an aesthetically pleasing manner; to provide a head covering which can be stored when wet without necessarily subjecting the storage area to unwanted water; and to provide a hat which is comfortable to wear.

These and other objects are achieved by a head covering made of a substantially flexible sheet material and comprising a crown, a brim, and a pocket secured to the crown and adapted to store the crown and brim when the hat is not in use. Preferably, the pocket has an opening at one end and is attached inside-out to the inside of the crown. The bottom of the pocket is positioned substantially adjacent where the crown joins the brim, and the opening of the pocket is opposite the bottom of the pocket. The crown and brim are foldable or otherwise capable of being stuffed into the pocket when the pocket is turned inside-in so that the pocket functions as a storage bag for the crown and brim.

Other objects of the invention will in part be obvious and will in part appear hereinafter. The invention accordingly comprises the product possessing the features, properties and relation of components which are exemplified in the following detailed disclosure and the scope of the application of which will be indicated in the claims.

For a fuller understanding of the nature and objects of the present invention reference should be had to the following detailed description taken in connection with the accompanying drawing wherein.

Figure 1:
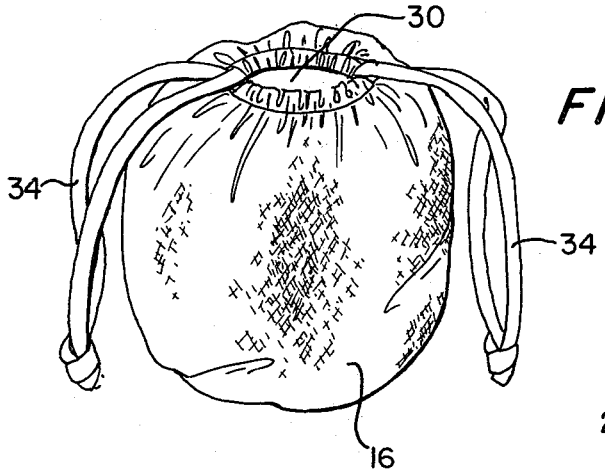
FIG. 1 is a perspective view of the pocket-bag in its inside-in condition and the crown and brim contained therein.
Figure 2:
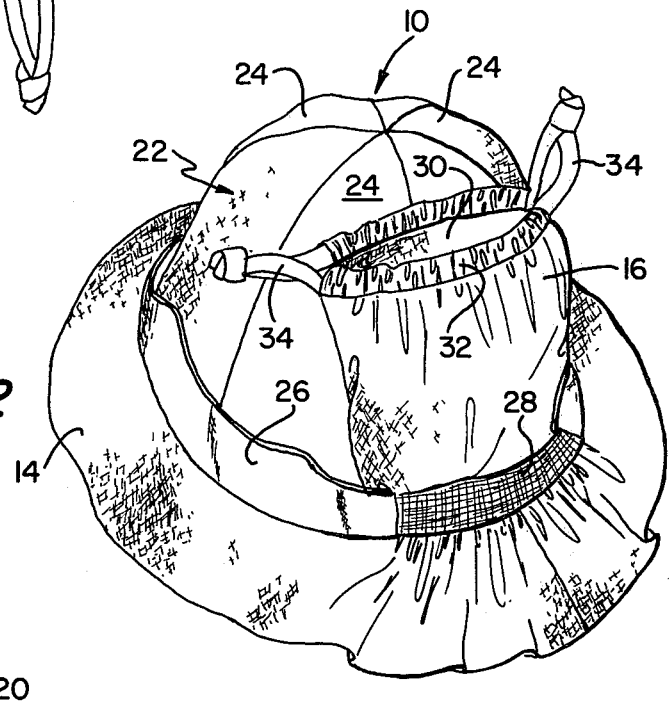
FIG. 2 is a perspective view of the pocket-bag and unfolded hat, both in their inside-out condition.
Figure 3:
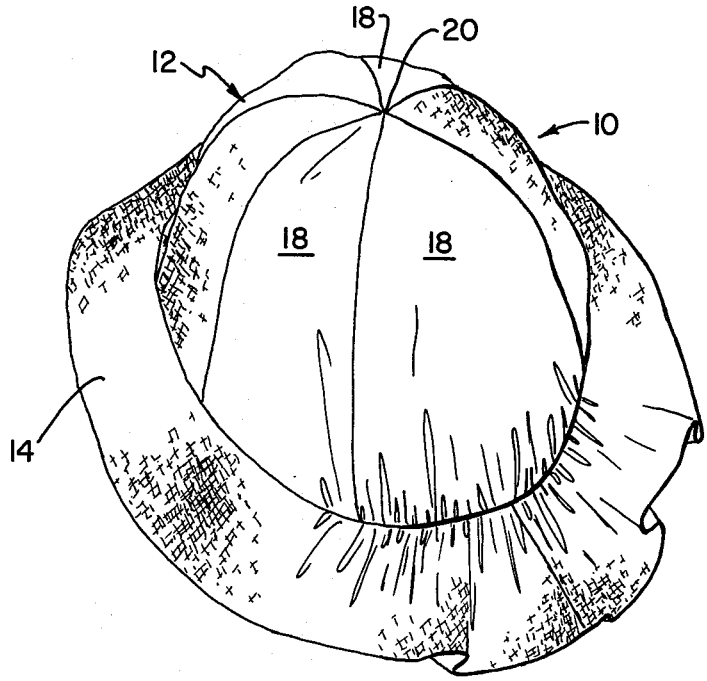
FIG. 3 is a perspective view of the hat in its inside-in condition.

Referring to the drawings, the head covering 10 generally comprises a crown 12, brim 14 and pocket-bag 16, all made of a flexible material preferably capable of resisting water absorption such as a hydrophobic material, e.g. nylon or polypropylene, or a finely woven material, e.g. cotton cambric, treated with a hydrophobic material, e.g., silicon, to make it water resistant or repellant. The crown is preferably made in six substantially triangular segments 18 stitched together so that an apex of each segment forms the center or top 20 of a dome-shaped crown while the base of each segment or more particular the periphery of the crown is joined, i.e. by stitching, to brim 14. As shown in FIG. 2, the inside of crown 12 is preferably provided with a lining 22 also formed of six substantially triangular segments 24 and sized to generally conform to the inside shape of the crown. The lining 22 is also joined to the brim 14 and may be made of a moisture absorbent material such as cotton so that the lining not only keeps the inside of crown 12 clean but also absorbs sweat providing comfort to the wearer. A circular headband 26 is also preferably provided on the inside of the crown and attached to the seam where the brim is attached. At least a portion 28 of the headband 26 is made of an elastisized stretchable material so that the head covering can be worn by people having various sized and shaped heads.

The pocket-bag 16 is preferably made of two pieces stitched together along its edges so as to provide an opening 30 at one end opposite the bottom of the pocket. Means are provided for at least partially closing the opening of the pocket-bag. More particularly, each piece of the pocket-bag at opening 30 is hemmed at 32 so that drawstrings 34 extend therethrough in order that the opening 30 can be at least partially drawn closed by pulling the drawstrings.

As shown in FIG. 2 the pocket-bag 16 is preferably attached to the inside of the head covering by turning both inside-out and securing the pocket-bag to either the inside of crown 12, e.g. by blind stitching, where no lining is provided, or to lining 22 so that no unnecessary stitches are made to the crown itself. In either situation, the pocket-bag is secured so that by turning the pocket-bag to its inside-in condition the remaining portion of the head covering can be folded or otherwise stuffed into the pocket-bag. Preferably, the pocket-bag is secured so that the bottom of the pocket-bag is positioned adjacent where the brim and crown and lining are joined, between elasticized portion 28 on the one hand and the crown and lining on the other hand. With the pocket-bag 16 folded inside-out and positioned as such, the head covering may be easily folded within the pocket-bag 16 and carried or stored.

More specifically, with the head covering turned in its inside-out condition (as shown in FIG. 2), the pocket-bag is turned to its inside-in condition. As this is done, the portion of the head covering adjacent the bottom of the pocket-bag is held with the pocket-bag so as to be inserted within the pocket-bag when the latter is turned inside-in. The remainder of the head covering is then folded or otherwise stuffed through opening 30 into the pocket-bag and the draw strings 34 tightened.

By attaching the pocket-bag to the inside of the crown in the manner described, (1) the head covering can be comfortably worn without the appearance of the pocket-bag; (2) the head covering is easily folded or otherwise stuffed within the pocket-bag providing an aesthetically pleasing self-contained unit, and (3) opening 12 of the bag is oriented toward the top 20 of the head covering, should it be desired to store small items, such as keys or the like, in the pocket when the hat is worn. It will be apparent that should any water be present on the outside of the crown or brim of the head covering the pocket bag should remain dry. Thus, when folding the crown and brim into the pocket-bag, the storage area in which the pocket-bag is placed will not be exposed to excess water.

Since certain changes may be made in the above product without departing from the scope of the invention herein involved, it is intended that all matter contained in the above description or shown in the accompanying drawing shall be interpreted in an illustrative and not in a limiting sense.

What is claimed is:

1. A head covering formed of a flexible sheet material and comprising:

a domed crown;

a brim secured to the periphery of said crown; and a pocket formed of flexible sheet material and attached inside-out to said crown, said pocket having an opening and being dimensioned so that said crown and brim can be stored within said pocket by turning the pocket inside-in and stuffing said crown and brim into said pocket.

2. A head covering according to claim 1, wherein said pocket is attached inside-out to the interior of said crown.

3. A head covering according to claim 2, wherein said pocket is secured within said crown so that (1) the opening of said pocket is oriented toward the top of said crown and said bottom of said pocket is adjacent a portion of said brim, and (2) said portion of said brim extends into said pocket when said pocket is turned inside-in and the remainder of said head covering can be stuffed through said opening into said pocket.

4. A head covering according to claim 2, wherein said crown further comprises a lining substantially conforming to the shape of said crown, said pocket being secured to said lining.

5. A head covering according to claim 2, further comprising a circular head-band attached to said head covering where said brim is secured to said crown.

6. A head covering according to claim 5, wherein said headband includes at least a portion of elasticized stretchable material so that said head band can be stretched to fit several sized and shaped heads.

7. A head covering according to claim 2, wherein said pocket is provided with means for at least partially closing said opening.

8. A head covering according to claim 7, wherein said means for at least partially closing said opening includes drawstrings.

9. A head covering according to claim 8, wherein said opening includes hemmed portions for receiving said drawstrings.

* * * * *